United States Patent [19]

Shapland

[11] 4,314,659

[45] Feb. 9, 1982

[54] ROTARY VALVE

[75] Inventor: Earl P. Shapland, Sarasota, Fla.

[73] Assignee: Flo-Con Systems, Inc., Champaign, Ill.

[21] Appl. No.: 166,589

[22] Filed: Jul. 7, 1980

Related U.S. Application Data

[63] Continuation of Ser. No. 916,467, Jun. 19, 1978, abandoned.

[51] Int. Cl.[3] ..... B22D 41/08

[52] U.S. Cl. ..... 222/590; 222/598; 251/301; 251/316

[58] Field of Search ..... 251/301, 314, 316, 328, 251/329; 222/598, 600, 555, 512, 590

[56] References Cited

U.S. PATENT DOCUMENTS

| | | | |
|---|---|---|---|
| 3,764,042 | 10/1973 | Shapland et al. | 222/600 X |
| 3,780,916 | 12/1973 | Shapland | 251/206 X |
| 3,841,539 | 10/1974 | Shapland et al. | 222/600 |
| 3,901,418 | 8/1975 | Klaus et al. | 222/600 |
| 3,912,135 | 10/1975 | Meier | 222/600 |
| 3,942,690 | 3/1976 | Lohrer | 222/600 |
| 4,063,668 | 12/1977 | Shapland et al. | 222/600 X |

FOREIGN PATENT DOCUMENTS

| | | | |
|---|---|---|---|
| 374454 | 6/1964 | Italy | 222/598 |

*Primary Examiner*—David A. Scherbel

*Attorney, Agent, or Firm*—Jack E. Dominik

[57] ABSTRACT

A rotary valve for teeming fluid metal is disclosed having a frame for securing the same beneath a metal vessel which has a working nozzle at its lower portion. A rotary gate carrier is provided within the frame, and a rotary gate is secured thereatop with one or more depending nozzles. The top plate is substantially coplanar with the rotary gate. The metallic case holding the rotary gate has one or more depending nozzle cases with inwardly extending locks. Nozzle extensions with recessed portions proportioned to permit insertion in concert with the locks in a bayonet fastener type relationship are provided whereby the lower nozzle extensions can be replaced. Desirably the nozzles in the rotary gate have different diameter bores thereby permitting different flow rates in accordance with erosion and clogging. The method of the invention is directed to the supplying of a top plate and bottom rotary gate for a rotary valve in which the top plate is assembled by securing two or more identical pieces together and providing a teeming opening or openings. Similarly the rotary plate is formed from the same identical pieces as the top plate, but securing therein nozzles preferably having different diameter teeming openings. The nozzle portion of the rotary gate is completed by providing for removable securing of nozzle extensions at the lower portion of the nozzles.

34 Claims, 9 Drawing Figures

ROTARY VALVE

CROSS-REFERENCE TO RELATED APPLICATION

The present application is a continuation under Rule 60 of application Ser. No. 916,467, filed June 19, 1978 now abandoned.

FIELD OF INVENTION

The present invention is directed to rotary valves of the character disclosed in U.S. Pat. Nos. 3,780,916; 3,912,134; and 3,764,047 all found in United States Classification 222, with varying subclasses.

SUMMARY OF PRIOR ART

In addition to the above-described patents, German Publication No. 2,411,800 and Swiss Pat. No. 374,454 also disclose rotary valves all of which are basically provided for presenting two different nozzles or pour tubes to a single teeming opening at the bottom of a teeming vessel. The principal advantage of a rotary type valve is to provide a greater length of travel of the imperforate of the rotating member than with a reciprocating type valve, to the end that erosion and break-out can be reduced.

High manganese steels are highly erosive. In a shop with a 300 ton ladle, where five ton ingots are being poured, 60 separate shut-offs are required in order to empty the ladle. A typical reciprocating sliding gate will not last for this many shut offs. Accordingly the advantage of a rotary valve, where that many shut-offs can be achieved, is self evident. The valves of the prior art, however, are of special construction, and do not provide for the easy and quick replacement of nozzles.

Another problem faced in teeming molten metal is a freezing of the metal at the lower edge of the pour tube. This phenomenon is referred to as bugging. Once bugging begins, the original build-up of frozen metal provides a surface for additional build-up. By utilizing a low conductivity material, the phenomenon of freezing or bugging can be dealt with successfully, but such a material erodes more rapidly and consequently such a nozzle should be replacable during the life of the valve. In addition, if a replaceable lower nozzle is provided, a smaller hole can be used to start the pour with a high head and, as the head is reduced, the erosion will open the hole and thus maintain an even teeming rate.

When using a submerged tube when the vessel is clogged it is very difficult to open for a pour. With a rotary valve habing a short tube an oxygen lance can be used to open and then the valve rotated to commence the pour through the submerged tube. The submerged tube may also be attached after the ladle is filled using the same bayonet type attachment.

SUMMARY OF INVENTION

The present invention is directed to a rotary valve for vessels teeming molten metals, and in particular to such a valve in which the lower portion of the nozzle of the rotary gate can be replaced. To provide for the same, the metallic material encasing the rotary plate as well as its depending nozzle extensions are provided with interlocking fastener means which permit the removal and replacement of a bottom portion of a nozzle to replace the same, particularly when erosion or bugging has occurred. The invention is also directed to a top plate and rotary gate which are formed from identical members, two or more on the top plate and two or more in the rotary gate. The nozzles used in the top plate are matingly engaged with collars provided on semicircular recesses on the plate to the end that no erosion or molten steel directly contacts the top plate or rotary gate plates except in the shut-off condition. In this fashion both the openings can be developed from different ceramics having the appropriate erosion and conductivity characteristics to deal with the type of metal being poured.

The method of the invention comprises the steps of assembly of the top plate and rotary gate from four or more identical members, each being positioned opposite a like member and defining nozzle receiving members having a collar extensible into the corresponding groove within the plug or pouring member. The same are then assembled and retained in a case to secure them in leak tight relationship. The lower member is provided further with nozzle cases having lock type projections which permit the insertion and removal of the nozzle extension. This method effectively permits the insertion of larger and smaller bore diameter nozzle extensions as well as the utilization of low conductivity, inserts to combat freezing and bugging which would otherwise occur in pouring certain steels with a high conductivity ceramic having better erosion characteristics.

Accordingly a principal object of the present invention is to provide a rotary valve in which the lower portion of the pouring nozzles of which can be changed easily.

An additional object of the present invention is directed to a rotary valve having its pouring portions and imperforate portion formed from a single sector, and providing for the mechanical retention of varying pouring elements which can be formed from a most desirable ceramic material for the particular metal and pouring operation.

Still another object of the present invention is to provide a method of assembling a rotary valve replaceable refractory portion which permits customizing the top plate and the rotary gate to the pouring conditions of a given customer, without requiring extensive tooling, and substantial inventory of top plates, rotary gates, and pour tubes.

Yet another object of the present invention is to provide a method for combating the difference in a head in a teeming vessel between the beginning of a pour and the end of the pour having widely varying flow rates.

A further object of the present invention is to provide a rotary valve and method for producing the same which is inherently safe in operation, and minimizes the potential of break-through, leakage, and an open pour condition which is not controllable by the operator.

A further object of the present invention is to provide a rotary valve which is easily and quickly serviced with replacement refractories by non-technical and inexperienced labor under the adverse working conditions of a steel mill pouring pit.

These last two objects are accomplished by utilizing pressure devices distributed under the entire area of the rotating plate to constantly urge it upward against the stationary plate. The pressure applied by these pressure devices is sufficient to deflect the plate and its surrounding metal case within their elastic limits so that the rotating plate conforms to the stationary plate even if the stationary plate is not completely flat. The resiliency of these pressure devices also allows for variations in plate thickness and for overtravel when devices such as the toggle devices utilized in the illustrated embodiment are used for attaching the supporting frame to the vessel.

DESCRIPTION OF DRAWINGS

Further objects and advantages of the present invention will become apparent as the following description proceeds, taken in conjunction with the accompanying illustrative drawings in which.

DESCRIPTION OF TWO NOZZLE EMBODIMENTS

Figure 1:
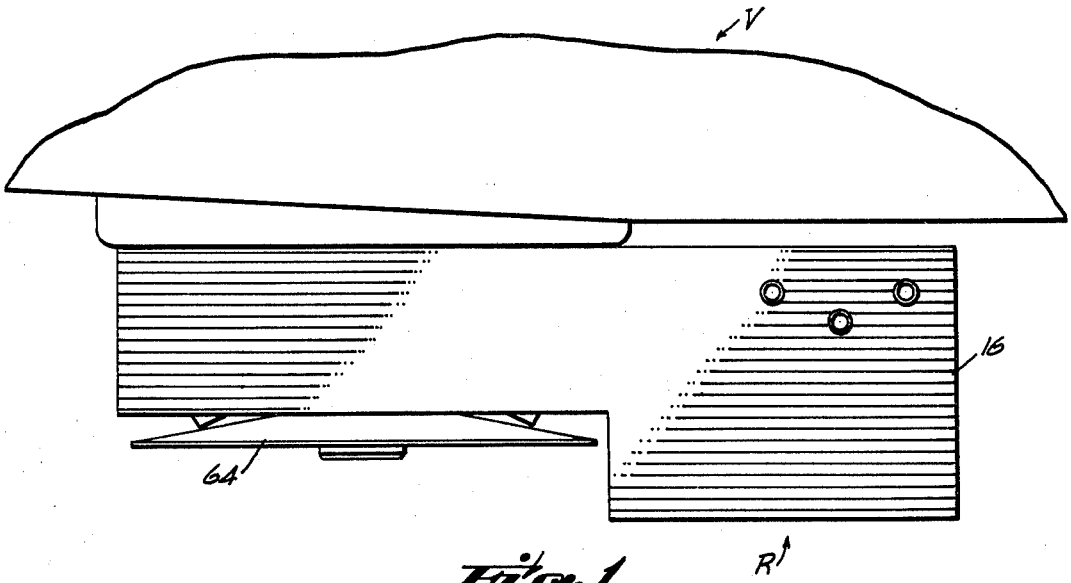
FIG. 1 is a front elevation of a lower portion of a pouring vessel utilizing a rotary valve illustrative of the present invention.
Figure 2:
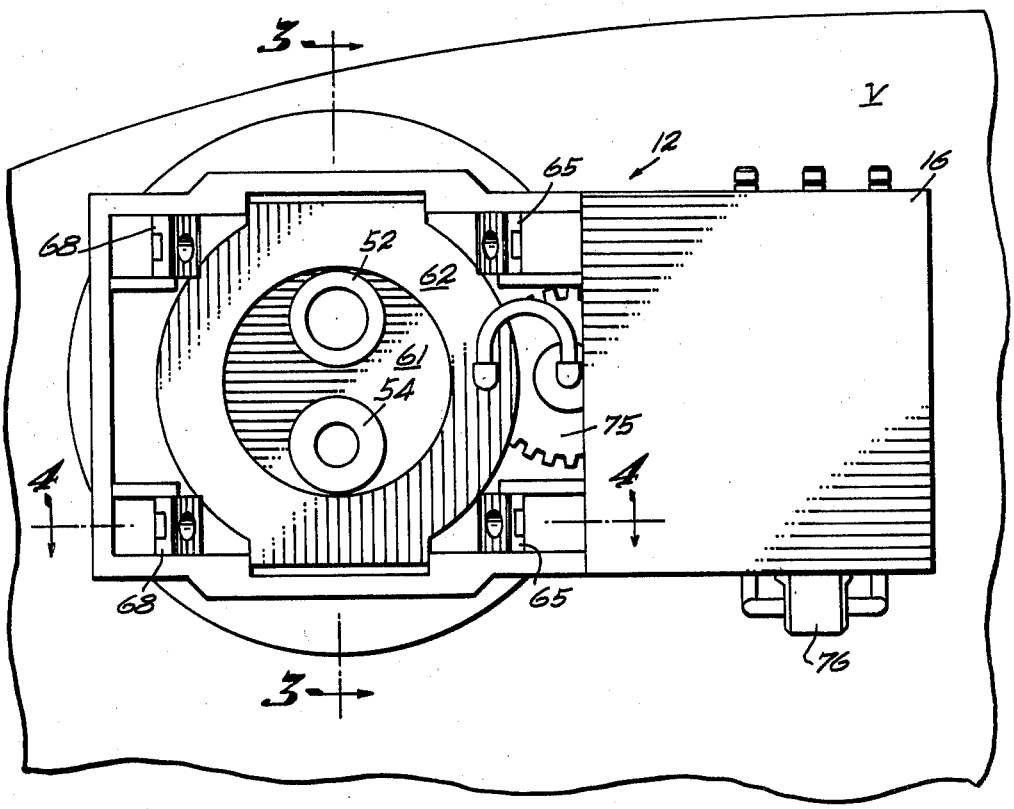
FIG. 2 is a bottom view of the rotary gate valve of FIG. 1 and showing the same in the same scale.

The present invention finds its principal utility in conjunction with a pouring vessel V, such as shown on FIG. 1, the pouring vessel primarily being a ladle for teeming molten metal, usually steel. Nonetheless other molten metals are contemplated. The rotary valve R, as shown in FIG. 1, is positioned beneath the vessel V, and has a single pouring opening operative at any one time extending beneath the frame 16 as shown in FIG. 1. More specifically, as viewed from the bottom, as shown in FIG. 2, the rotary valve R has a nozzle extension 52 with a large pour opening and a nozzle extension 54 with a small pour opening extending beneath a support ring 62 for the rotary gate carrier 61.

Figure 3:
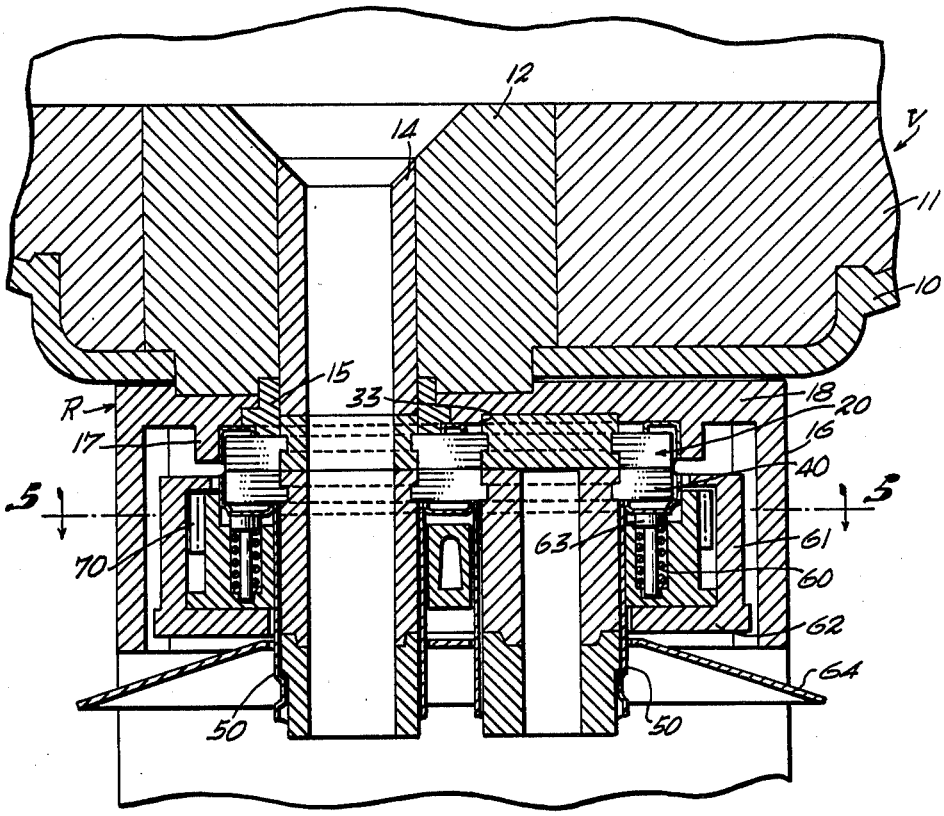
FIG. 3 is a transverse sectional view of the rotary valve of FIG. 2 taken along section line 3—3 of FIG. 2 showing the interior portion of the differing diameter nozzles in the rotary gate.

Turning now to FIG. 3, it will be seen that the vessel V includes a metal shell 10 as its outer portion, and an interior refractory lining 11. A hole is provided in the lower central portion of the refractory lining 11 for the mounting of a well block 12, which further contains interiorly thereof a working nozzle 14, which is in teeming communication with the bottom of the vessel V.

Figure 4:
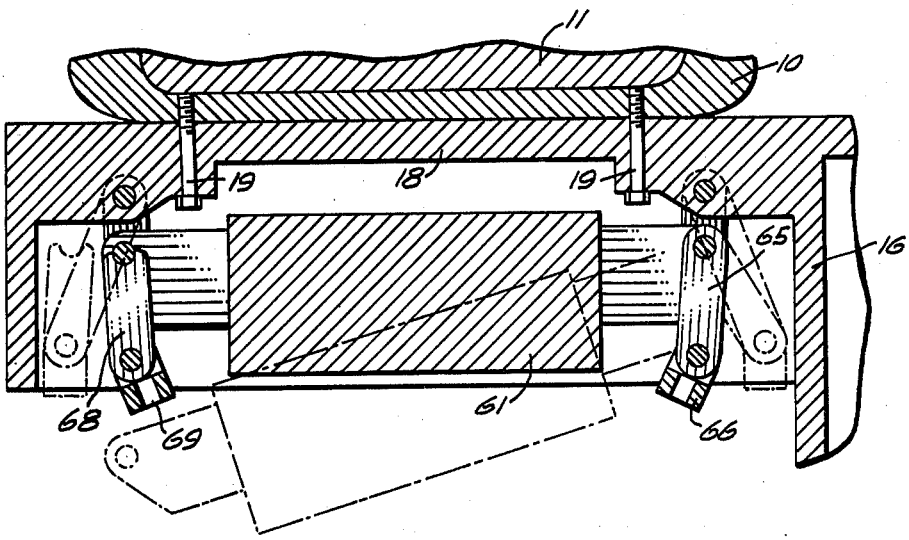
FIG. 4 is a longitudinal sectional view taken along section line 4—4 of FIG. 2, showing in phantom lines the open and closed configuration of the rotary gate frame.

Desirably a safety collar 15 is provided peripherally around the working nozzle 14, and is secured to the frame 16 and its mounting plate 18. The frame 16 of the rotary valve R extends around the rotary valve R, but its upper portion 18 defines the mounting plate which, as seen in FIG. 4, is secured to the metal shell 10 of the pouring vessel V by means of mounting bolts 19.

A top plate 20 (as seen in FIG. 3) is positioned within a top plate block ring 17 which depends from the mounting plate 18. A rotary gate 40 is positioned beneath the top plate 20, and held thereagainst by means of the pressure devices 60 which are mounted within the rotary gate carrier 61. The rotary gate carrier, in turn, has a lower face which is positioned atop the support ring portion 62 of the frame 16. Further as will be noted in FIG. 3, a splatter shield 64 is provided in surrounding relationship to the nozzle cases 50. Provision for removing the top plate as well as the rotary gate 20, 40 is shown in FIG. 4 where it will be seen that the rotary gate carrier 61 is secured within the frame 16 by means of a pivot toggle 65 secured to the mounting plate 18, which has a pivot toggle actuator 66 permitting the same to be pivoted to a distance in greater space relationship from the mounting plate 18 than in normal operation. Similarly, at a station on the opposite side of the rotary gate carrier 61, provision is made for a latch toggle 68 which is engaged by a latch toggle activator 69, permitting a lowering and tilting of the rotary gate carrier 61, to a position such as shown in phantom lines in FIG. 4 for removal and servicing.

Figure 5:
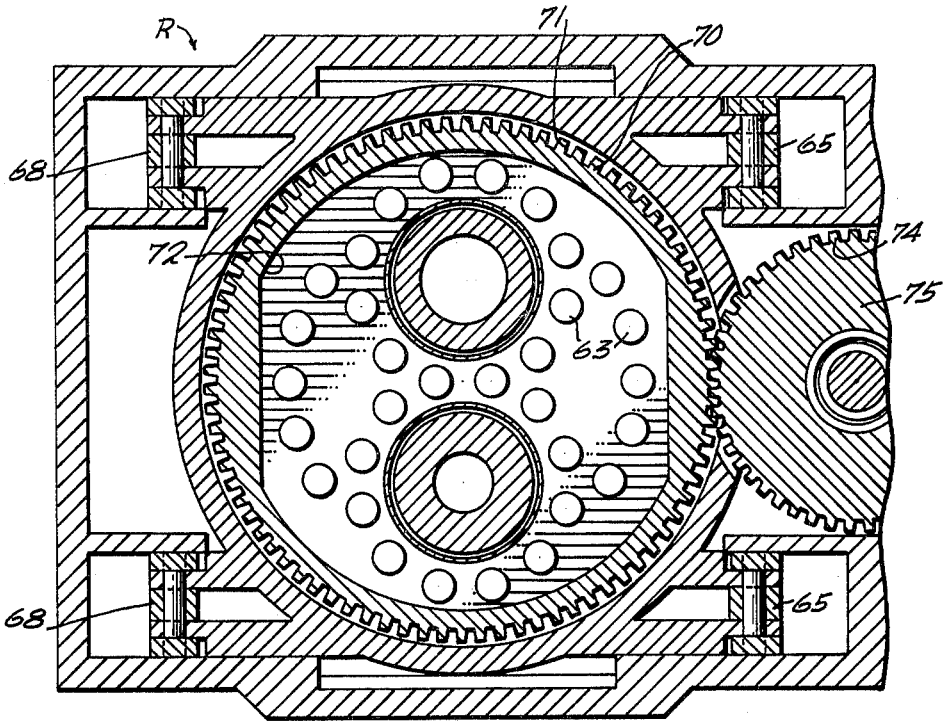
FIG. 5 is a horizontal section taken along section line 5—5 of FIG. 3 showing the interior portion of the rotary valve and more particularly the gear mechanism for driving the same.
Figure 7:
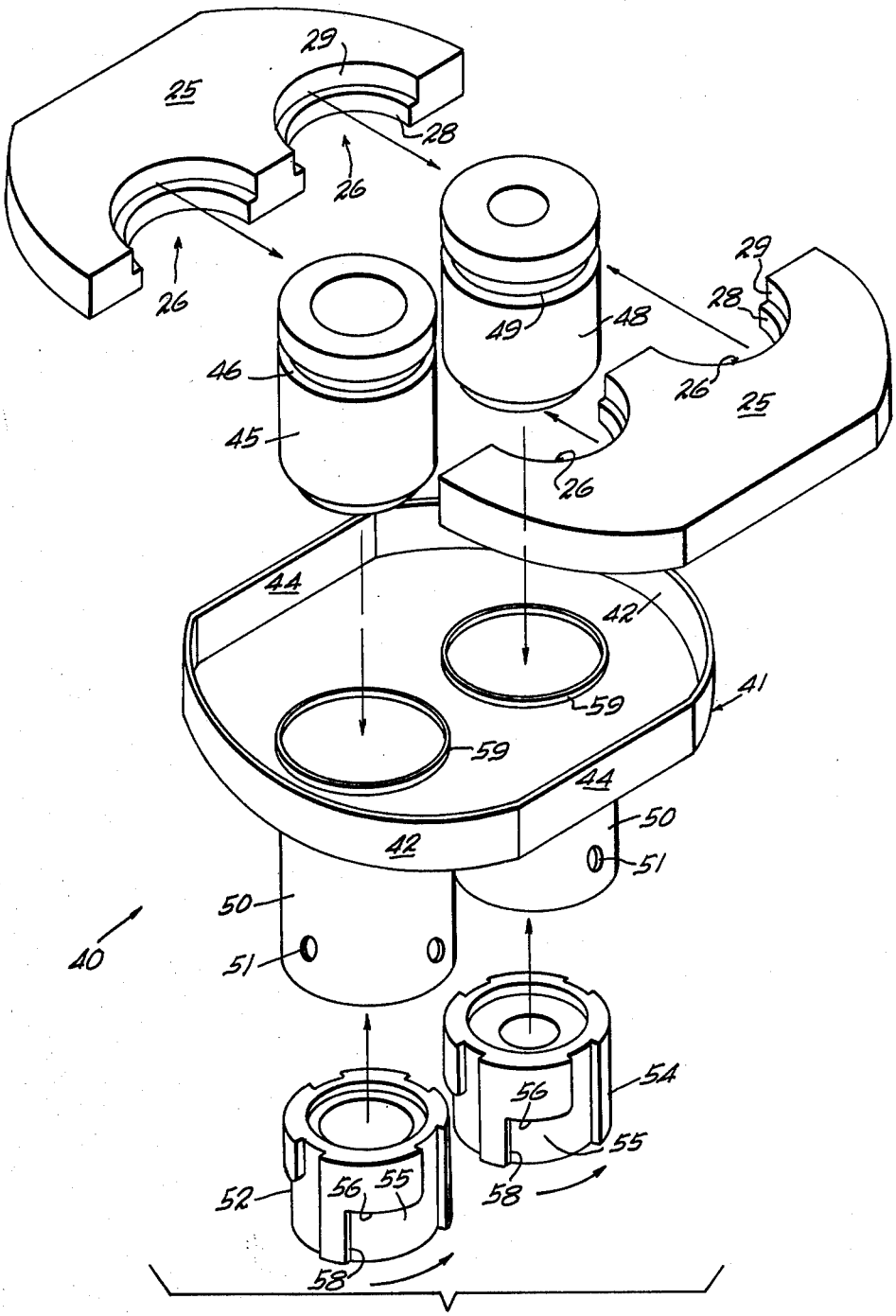
FIG. 7 is an exploded perspective view of the method of forming a rotary gate with two nozzles utilizing the two plate members also used in connection with the top plate, and further illustrating the method for removing the two lower nozzle extensions.

Turning now to FIG. 5, it will be seen that the rotary gate R is driven by means of a bull gear 70 having a plurality of peripheral teeth 71. A rotary gate recess 72 is provided interiorly of the bull gear 70, and contains the rotary gate 40, the same being secured in place by means of the flats in the rotary gate recess which engage corresponding flats 44 on the rotary gate and the curvilinear portion 42 on the rotary gate as shown in FIG. 7. The bull gear 70 is driven by means of a drive pinion 75 the peripheral teeth 74 of which engage the teeth 71 and through a drive mechanism 76 (see FIG. 2) the drive pinion 75 is actuated to perform a rotation of the rotary gate 40.

Large refractory parts when used in sliding gate valves, are difficult to produce effectively from the standpoint of maintaining uniform refractory quality throughout the pressing that forms the part. It is contemplated by the present invention, that this problem can be reduced by producing the part as two smaller sections which are ultimately assembled into the finished part. This achieves a better finished product when evaluated as to uniformity of quality. In addition, because the two smaller sections are used for the basic refractory, nozzle inserts can be locked between the two sections. The nozzle inserts into plates (whether top plates or sliding gates) are normally cemented or press-fitted into an opening provided in a refractory plate. The walls of both the insert and the opening are smooth, which makes possible relative axial movement between the two members. When such movement occurs, the smoothness of the sliding surfaces of the top plate and gate plate is disrupted thereby permitting the possibility of metal leaking into the interface which requires replacement of the plates. This problem is avoided in the described arrangement, since a mechanical lock is provided to prevent relative axial movement between the plate and the insert. Further to be noted in the following detailed description, drawing reference to FIG. 3, is that the nozzle insert extends above the upper surface of the top plate into the interior of the safety nozzle 15, thereby sealing the same between the top plate nozzle and the working nozzle 14. The frame is recessed at 33 to accommodate the extended axial length of the plug 35.

Figure 6:
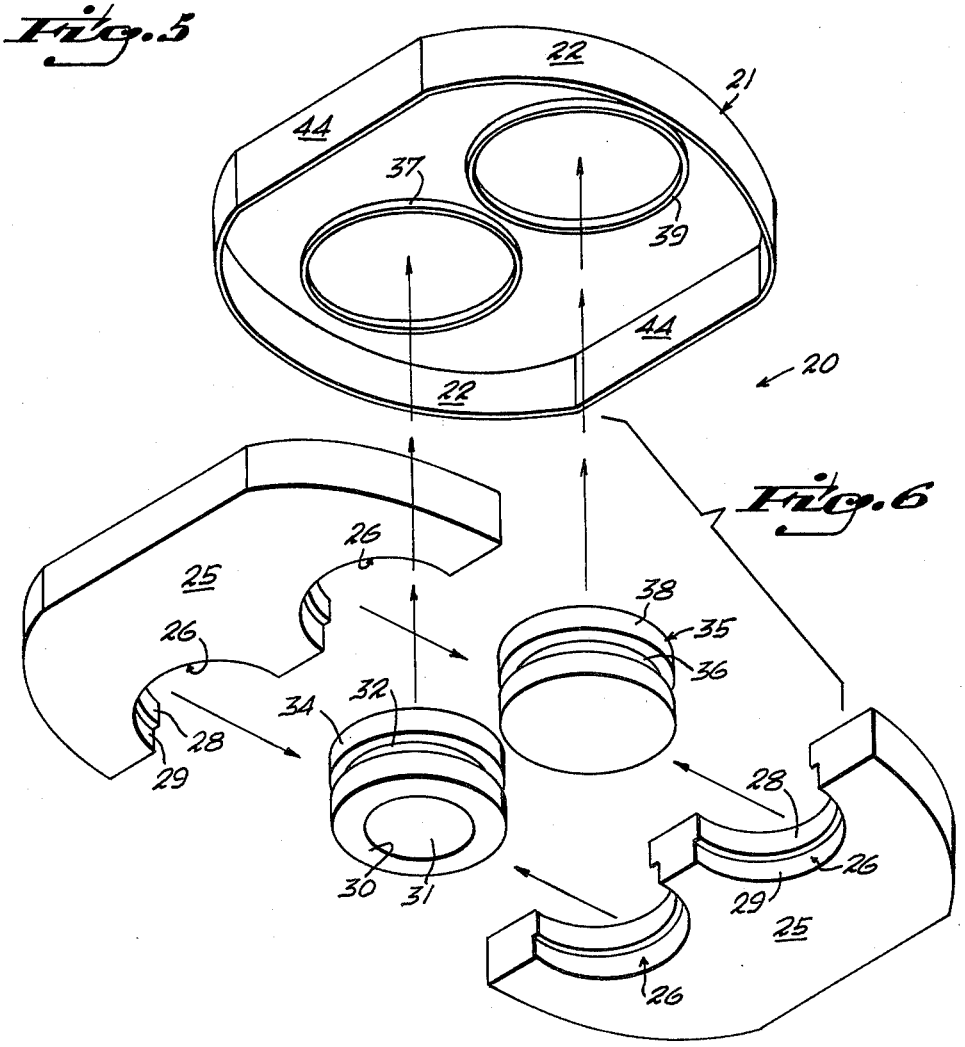
FIG. 6 is an exploded perspective view illustrating the method of forming the top plate from two identical members.

The specific construction of the top plate 20 is highlighted in FIG. 6 where it will be seen that a metallic case 21 is provided having opposed curved depending side walls 22, and opposed locking flats 44. A pair of identical refractory plates 25 are provided, each of which has two semi-circular recesses 26 containing a locking collar 28 and an undercut 29. A top plate nozzle 30 is engaged by two of the opposed semi-circular recesses 26, the top plate nozzle 30 having a pour opening 31 at a central portion, and a locking groove 32 around its periphery, the locking groove being engaged by the opposed locking collars 28 of the semi-circular recesses 26 in the refractory plates 25. This permits the upper portion of the top plate nozzle 30 to extend above the metallic case 21, and (as shown in FIG. 3) be received by the safety collar 15 provided beneath the working nozzle 14 of the teeming vessel V. The safety collar ring 34 of the top plate nozzle thus is secured to the principal teeming opening in a safety relationship. Also to be noted is the provision of a top plate plug 35 which also has a locking groove 36, which is received by the opposed locking collars 28 of the refractory plates 25 and which engage the locking grooves 36. The mount lock entension 38 of the top plate plug 35 fits within a plug recess 33 provided at a lower portion of the mounting plate 18 as shown in FIG. 3. Nozzle access ring 37 and plug access ring 39 are provided in the metallic case 21, and the parts, when assembled, are mortared into and securely bound within the metallic casing 21 to thus define a completed top plate 20.

Turning now to FIG. 7, it will be seen that a rotary gate 40 also contemplates a metallic case 41, and the utilization of the same identical refractory plates 25 as utilized in the top plate 20, and where parts are common, common reference numerals will be employed. The refractory plates 25 thus employed in the rotary gate 40, also are provided with a semi-circular pair of recesses 26, and a locking collar 28 with a corresponding undercut 29. The metallic case 41 has curved side walls 42, as well as opposed locking flats 44. Provision is made for a large bore nozzle 45 having a locking groove 46, which is matingly engaged by one of the locking collars 28 of the opposed refractory plates 25. The large bore nozzle 45 is proportioned so that its upper surface does not extend above the upper surface of the opposed refractory plates 25. Correspondingly, a small bore nozzle 48 is provided having a locking groove 49 which similarly is engaged by the opposed locking collars 28.

The small bore nozzle 48 portion of the rotary gate 40 also has a locking groove 49, which is engaged by the opposed locking collars 28 of the refractory plates 25. Both of the nozzles 45, 48 extend downwardly through nozzle access rings 59 in the metallic case 41. Both of them extend into the depending nozzle cases 50 which have an extension lock 51 at their lower portion. When the rotary gate 40 is assembled, it may or may not contain the large bore extension 52 and the small bore extension 54 as shown. The opposed refractory plates 25 and the nozzles 45, 48 are securely mounted into plate within the metallic case 41 to thus define the rotary gate 40. As pointed out earlier, the type of ceramics as well as the size of the bore of nozzles 45, 48 can be preselected for the particular pouring conditions. In addition, a large bore extension and small bore extension 52, 54 may be secured independently interiorly of the nozzle case 50 and locked by means of the extension lock 51 because, as shown, each of the extensions 52, 54 is provided with a lock undercut 55, and a lock shoulder 56 which finds itself positioned above the extension lock 51 of the nozzle case 50 and rotate it until engaging the lock stop 58. Thus each of the extensions 52, 54 may be removably secured beneath the permanently installed nozzle 45, 48, either immediately prior to use, at the time of shipment, or during the course of use based upon the amount of erosion or other damage which may occur to the extension.

SINGLE NOZZLE EMBODIMENT

Figure 8:
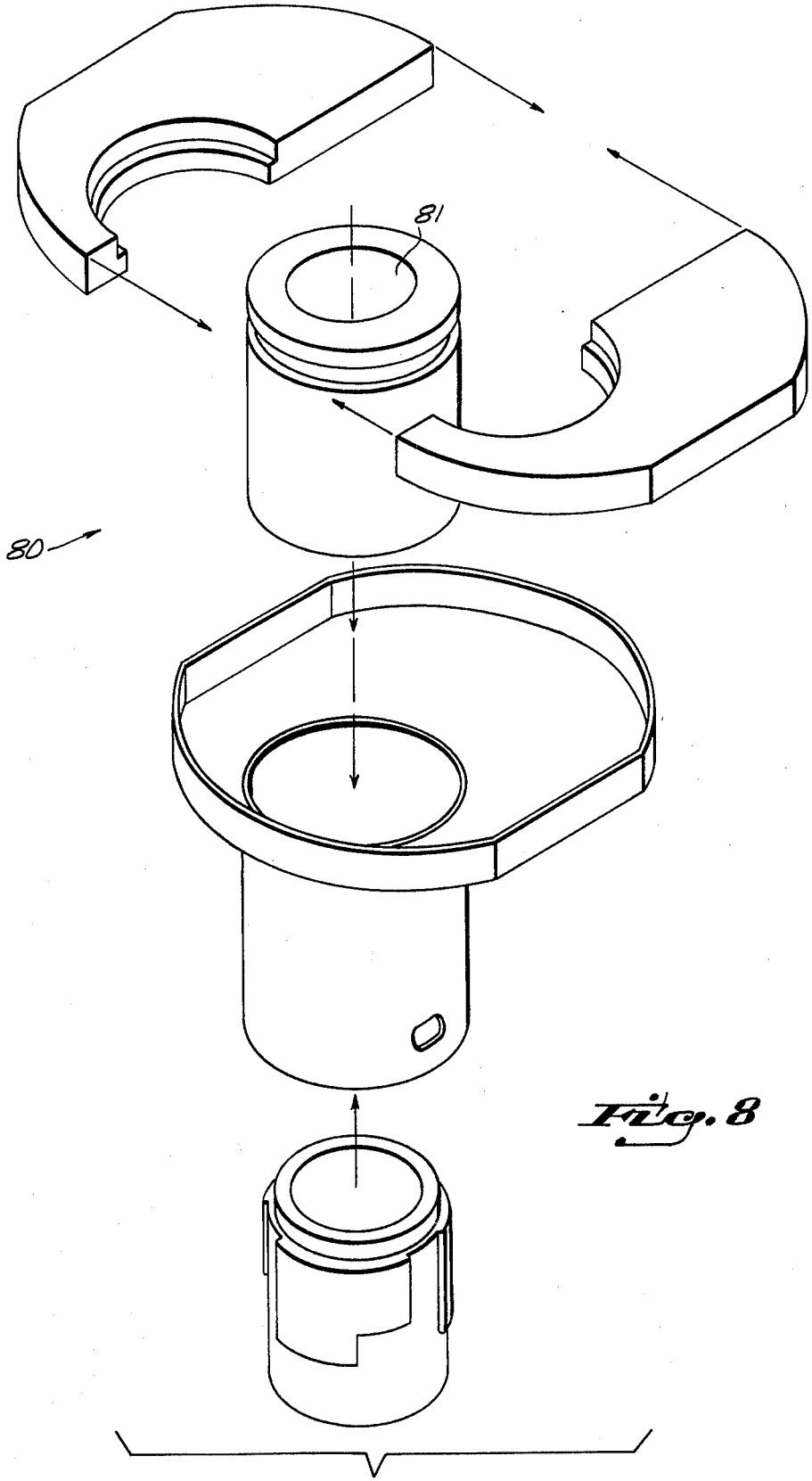
FIG. 8 is an exploded perspective view of the rotary gate like FIG. 7 but directed to an alternative embodiment having a single nozzle.

As shown in FIG. 8 a single nozzle rotary gate 80 plate (not shown) can be fabricated having only one teeming opening 81. This permits the use of larger bores within a given outside configuration or even in an existing valve. As an example the illustrated single hole gate 80 may have a nozzle as large as 7 inches and yet it fits within the outer dimension of a two hole gate that is limited to a maximum bore of 5 inches. The flow rate of the 7 inch bore is twice that of a 5 inch bore. This increase in available flow rate would allow application of the valve to charging ladles, torpedo cars, and even to furnaces.

SIX NOZZLE EMBODIMENT

Figure 9:
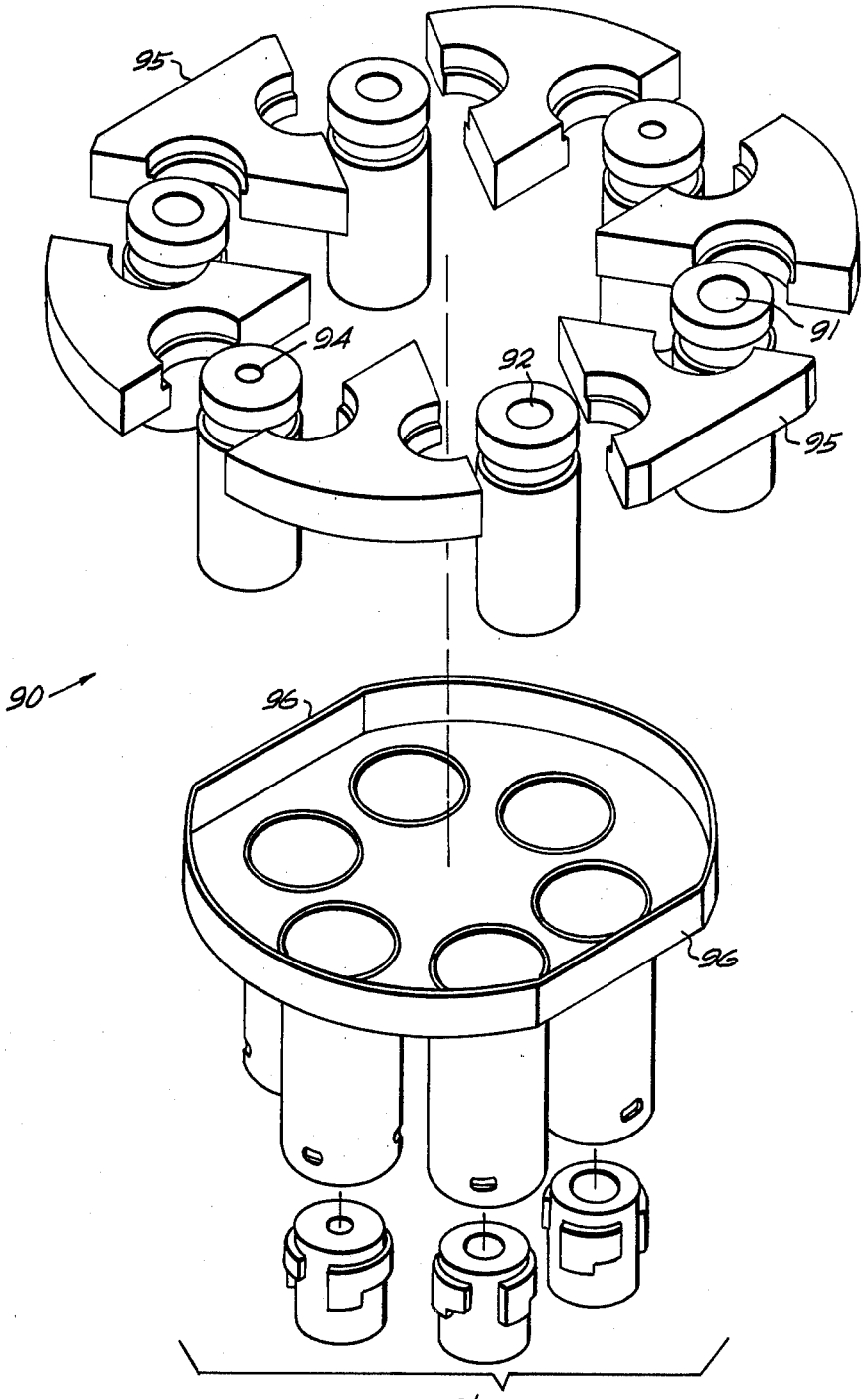
FIG. 9 like FIGS. 8 and 7, is an exploded perspective view of the rotary gate but directed to yet another alternative embodiment having six nozzles.

The six hole gate 90 shown in FIG. 9 provides at least two functional advantages. The use of several different bore sizes allows uniform teeming rates when the ladle is full as well as when it is nearly empty without throttling or at least with minimal throttling. Metalurgical quality of steel ingots is adversely effected by both non-uniform teeming rates and by the flaring stream that results from throttling. Too fast or too slow a fill rate is detrimental to ingot quality. A flaring stream re-oxidizes during teeming resulting in ingot inclusions and a flaring stream sticks to ingot mold sidewalls and results in poor surface quality. Continuous cast steel also suffers from re-oxidizing due to a flaring stream and absolutely demands a constant teeming rate in order to maintain constant withdrawal rate from the mold.

The use of multiple bores provides more "shut-offs" between plate changes saving time and permitting teeming of more smaller ingots from a given ladle size.

As illustrated in FIG. 9, the six hole gate has two series of three bore sizes. As an example these are $2\frac{1}{2}''$ 91, $1\frac{3}{4}''$ 92 and $1\frac{1}{4}''$ 94. The $1\frac{3}{4}''$ inch allows flow rates of one half the $2\frac{1}{2}$ inch and the $1\frac{1}{4}$ inch would provide flow rates of one half the $1\frac{3}{4}$ inch or one quarter the flow rate of the $2\frac{1}{2}$ inch.

MATERIALS

The preferred material for the plates is a highly shock-resistant refractory that also has a high abrasion resistance. Generally this is an 85 to 95% alumina refractory body made from tabular alumina. The material used for the nozzle in the top plate must be highly erosive resistant. The top plate assembly shown keeps the amount of material in the orifice nozzle to a minimum which permits the economical use of some of the more expensive refractory materials such as the zirconium oxides.

The material used for the gate nozzles also must be highly abrasion resistant. The thru bore design shown allows the nozzle, which is all that is exposed to the flowing stream, to be of a different material than the plates.

The assemblies illustrated allows use of different materials in the top plate nozzle and gate nozzles. These can be varied to better accomodate the steel to be teemed. A few examples of this are outlined below.

*Aluminum killed steels* are soft and do not abrade refractories but rather they tend to precipitate aluminum oxide which adheres to the refractory and restricts the flow. A low alumina, clay type refractory can be used for these grades as they are less expensive, better insulators, resist aluminum oxide deposits and the fact that they are poor from an errosion resistant standpoint is not a disadvantage with these grades of steel.

*Rimming grades of steel* contain much dissolved oxygen and they chemically errode many refractories. In some cases it has been found that magnesium oxide or "basic" refractories resist this action best.

*High manganese grades of steel* and particularly those having high manganese and high carbon are highly abrasive and "acid" refractories of the high alumina type or even zirconium oxide resist this best.

The generally preferred material for the gate nozzle extension is a good insulator to reduce "bugging" or freezing of the teeming steel on the edge of the extension orifice. When this occurs the stream is deflected and flares badly causing an increase in reoxidation. Most good insulators are not highly errosion resistant so extensions of these materials need to be replaced before the other refractories of the gate and top plate. The bayonet attachment allows this to be done easily and quickly.

When a submerged pouring tube or long tube is used, it is attached in the same manner and then lowered so that its discharge end extends into the molten pool below. These tubes are generally made of one of two materials. Fused silica tubes are used with aluminum killed and other low abrasive steels as they have good shock resistance so that they do not require preheating and they minimize aluminum oxide deposit problems being non-alumina and an excellent insulator. Alumina graphite tubes must be used with highly abrasive steels such as high manganese, high carbon grades even though they require preheating before installation.

THE METHOD

The method of the present invention, as summarized above, is directed primarily to a sequence of steps whereby identical refractory plates 25 can be employed with a top plate metallic case 41 and a rotary gate metallic case 41 to economically fabricate the replaceable parts of a rotary gate R. The economies are achieved by means of utilizing a single identical refractory plate 25 to define the interface between the top plate 20 and the rotary gate 40. By selecting a particular type top plate nozzle 30, the top plate nozzle 30 may have a pour opening 31 in accordance with the use intended, as well as a ceramic material with the erosion, conductivity, and other properties desired for the operation. Similarly, the top plate plug 35 may be formed of the ceramic of the choice for the particular pour. Once the selections of the top plate nozzle and top plate plug are made, the parts are secured in place within the metallic case 21, mortared for a secure connection therewith, and then desirably ground to provide a smooth surface at the interface between the top plate 20 and the sliding gate 40. Further as pointed out above, both the top plate plug 35, and the top plate nozzle 30 extend upwardly through the nozzle access ring 37 and plug access ring 39 for their ultimate secured relationship with the mounting plate 18 as shown in FIG. 3.

The method of forming the rotary gate 40, as illustrated in FIG. 7, contemplates using the same identical refractory plates 25 as used with the top plate, and thereafter selecting nozzles 45, 48 with the appropriate bore or pouring diameter, as well as material, for the intended operation. Thereafter the two top plates 25 are pressed into position to lockingly engage the nozzles 45, 48 and the same are mortared into the metallic case 41. Thereafter, different extensions 52, 54 may be positioned in the nozzle case 50, again with the pour diameter or through bore being preselected for the particular operation involved, as well as the material.

The method of forming a single nozzle rotary gate and top plate, as shown in FIG. 8, is essentially the same. When more nozzles are employed, such as six as shown in FIG. 9, a second diamond shaped section 95 is employed but used in opposed relationship to itself against the locking flats 95.

Often it is desirable to use a submerged pour tube or nozzle. They can be used in conjunction with a short tube or nozzle such as in the two nozzle embodiment.

In the event the steel becomes frozen in the pouring vessel, the short tube is positioned in the operating configuration, and an oxygen lance applied thru the short tube in order to open or start the pour. Thereafter, the submerged tube is rotated into position, and pouring continues. It is virtually impossible to oxygen lance through a long, submerged tube, some such tubes being as long as 4 and 5 feet.

The extension can be replaced during a pour in the shutoff condition by using a remote handling device, the operative portion of which is essentially a screw extractor. The extensions are preferably mortared in with a non-binding type clay mortar which renders removal and replacement easy.

Also, as shown in FIG. 9, it is possible to fabricate the gate plate of three or more pieces, thereby having more than two depending nozzles. As the number of nozzles are increased, naturally the shutoff distance upon rotation is decreased, and there comes a time, depending upon the radius of rotation where further pouring tubes become impractical. Nonetheless, the invention is capable of such variations.

THE METHOD OF SEALING

A further problem addressed by another aspect of the present method arises from the warpage of the back plate 18 of the rotary valve assemblage "R". In virtually all valve installations, even though the steel back plate behind the stationary top plate is some three inches thick, at temperatures of 900° F., this temperature is some 300° above the "creep" temperature for steel. Accordingly during successive pours, the back plate or steel casing 10 of the vessel, as well as the back plate 18 of the valve is inclined to warp at a rate and intensity which is not predictable. Nor can this be controlled adequately by known forms of cooling.

To accomodate the above problem, it is contemplated that the rotary valve top plate 20 which is stationary, as well as the rotary gate 40 are spring loaded in such a fashion as to cause a deflection corresponding mutually with the deflection or warpage of the back plate, to the end that the interface between the two ceramic members will be in constant fluid tight pressure relationship. This method is carried out through the means of a plurality of load pads 60, distributed as shown best in FIG. 5 (in conjunction with FIG. 3) in such a manner that they surround the nozzles, as well as uniformly or dispursed over the ceramic members.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A top plate formed from two ceramic pieces for a rotary gate valve comprising, in combination, a metallic housing for containing the ceramic pieces, a formed ceramic plate having at least two centrally disposed semi-circular sections for retaining a further ceramic member, at least two ceramic members for insertion between said semi-circular members, one or more of said semi-circular encased members being an imperforate plug, one of said members being a pouring member having a central aperture like teeming opening, a mechanical interlock means for securing said imperforate and pouring members between the ceramic plates, each of said ceramic plates being identical in configuration, whereby a single plate member can be employed with a variety of pouring and plugging members selected from the appropriate ceramic for the intended pour.

2. In the top plate of claim 1, said insertion members having a central peripheral groove, said semi-circular sections having a locking collar whereby said ceramic members are secured to said ceramic plates with an extending upper portion.

3. For use with a rotary valve, a rotary bottom gate comprising, in combination, a metal housing for encasing ceramic elements having at least two depending tubular members, two or more identical pieces of ceramic flat plate for positioning within the housing, each said member having a semi-circular aperture portion therein, tubular inserts for positioning within the circles defined by the opposed semi-circles, means for interlocking said tubular members into position, said tubular members extending down a portion of the metallic tubular members beneath the case, a further lower ceramic tubular insert having means for receiving a locking member, and locking members on the metallic tubular portion, whereby the lower ceramic member of the pour tubes may be replaced during the course of a pour.

4. In the rotary bottom gate of claim 3, said locking members for said replaceable tube being a cooperative bayonet fastener.

5. A rotary valve for pouring teeming metal from the lower portion of a teeming vessel having an aperture therein comprising, in combination, frame having means for securing it to the lower portion of the teeming vessel, a rotary drive means positioned within the frame for receiving a rotary valve, a top plate for positioning beneath the upper surface of the frame and in teeming communication with the vessel aperture having a nozzle insert therein secured by two or more identical ceramic slabs, a rotary gate defined by a metallic case having a depending case portion for a pour tube, two or more plates in said rotary gate identical to the plates in the top plate, a pour tube engaged within the metal case and secured by opposed semi-circular portions in the plates, means for rotating said rotary gate in fluid tight relationship to the face of the top plate, whereby the valve can teem metal from the nozzle provided in the rotary gate or terminate teeming flow by rotation of the rotary gate.

6. In the top plate of claim 5, said insertion members having a central peripheral groove, said semi-circular sections having a locking collar whereby said ceramic members are secured to said ceramic plates with an extending upper portion.

7. In the rotary valve of claim 5, a second removable and replaceable ceramic member comprising an extension of said pour tube.

8. In the rotary valve of claim 7, bayonet fastener means for removably securing said second replaceable member.

9. The method of forming a top plate for a rotary gate valve comprising the steps of, forming a plate member having a pair of semi-circular recesses, providing a metallic case for containing the identically formed flat plate members and semi-circular opposed relationship, positioning one or more imperforate plugs and/or pour nozzle interiorly of the opposed semi-circular members, and then securing the same interiorly of the metal case for positioning beneath a pouring vessel.

10. In the method of claim 9 above, utilizing the same opposed plate members having semi-circular cutout portions to define a mating rotary gate.

11. The method of forming a rotary gate for a teeming vessel comprising the steps of, providing a metallic case with depending nozzle cases for a ceramic plate and two or more nozzles, providing two or more identical ceramic plate members having opposed semi-circular sections, positioning ceramic members interiorly of said opposed semi-circular sections and depending the same into the metallic nozzle portions of the casing, and providing means in the lower portion of the tubular casings beneath the thus positioned nozzle ceramic portions for removably securing a further ceramic nozzle portion in the lower portion of said tubular casing, whereby two or more identical members can be employed to define the plate portion of the rotary gates, and customization of the pour nozzle portions can be achieved, along with replaceability of the lower extension of the pour nozzles.

12. In the method of claim 11 above, a further step of utilizing the same plate members to define the flat plate portion of a top plate.

13. A top plate for a rotary gate valve comprising, in combination, a metallic housing for containing the ceramic pieces, a formed ceramic plate having a centrally disposed semi-circular section for retaining a further ceramic member, perforate ceramic member for insertion between said semi-circular sections, said insertion member being a pouring member having a central aperture like teeming opening, a mechanical interlock means for securing said pouring member between the ceramic plates, each of said ceramic plates being identical in configuration, whereby a single plate member can be employed with a variety of pouring members selected from the appropriate ceramic for the intended pour.

14. For use with a rotary valve, a rotary bottom gate comprising, in combination, a metal housing for encasing ceramic elements having a depending tubular member, two identical pieces of ceramic flat plate for positioning within the housing, each said member having a semi-circular aperture portion therein, a tubular insert for positioning within the circles defined by the opposed semi-circles, means for interlocking said tubular member into position, said tubular member extending down a portion of the metallic tubular members beneath the case, a further lower ceramic tubular insert having means for receiving a locking member, and locking means on the metallic tubular portion, whereby the lower ceramic member of the pour tube may be replaced during the course of a pour.

15. In the rotary valve of claim 14, said locking means comprising a bayonet fastener.

16. In the rotary valve of claim 15, said bayonet fastener comprising undercuts on said tubular inserts and mating extensions in said metallic tubular portion.

17. A rotary valve for pouring teeming metal from the lower portion of a teeming vessel having an aperture therein comprising, in combination, frame having means for securing it to the lower portion of the teeming vessel, a rotary drive means positioned within the frame for receiving a rotary valve, a top plate for positioning beneath the upper surface of the frame and in teeming communication with the vessel aperture having a nozzle insert therein in mechanical interlocking relationship with two or more identical ceramic slabs, a rotary gate defined by a metallic case having a depending case portion for a pour tube, two or more plates in said rotary gate identical to the plates in the top plate, a pour tube engaged within the metal case and secured by opposed semi-circular portions in the plates, means for rotating said rotary gate in fluid tight relationship to the face of the top plate, whereby the valve can teem metal from the nozzle porvided in the rotary gate or terminate teeming flow by rotation of the rotary gate.

18. The method of forming a top plate for a rotary gate valve comprising the steps of, forming a plate member having a pair of semicircular recesses, providing a metallic case for containing the identically formed flat plate members and semi-circular opposed relationship, positioning a pour nozzle interiorly of the opposed semi-circular members, and then securing the same interiorly of the metal case for positioning beneath a pouring vessel.

19. The method of forming a rotary gate for a teeming vessel comprising the steps of, providing a metallic case with a depending nozzle case for a ceramic plate and one or more nozzles, providing two or more identical ceramic plate members having opposed semi-circular sections, positioning a pouring ceramic member interiorly of said opposed semi-circular sections and depending the same into the metallic nozzle portions of the casing, and providing means in the lower portion of the tubular casing beneath the thus positioned nozzle ceramic portion for removably securing a further ceramic nozzle portion in the lower portion of said tubular casing, whereby two or more identical members can be employed to define the plate portion of the rotary gates, and customization of the pour nozzle portions can be achieved, along with replaceability of the lower extension of the pour nozzles.

20. The method of accommodating deflection in a rotary valve having a stationary top plate, and a rotary gate having more than one depending nozzle comprising the steps of, providing at least two refractory plates to form the stationary top plate, inserting at least one nozzle interlocked between the refractory plates, retaining the stationary top plate and the rotary gate within a frame, providing a plurality of substantially uniformly dispersed load pads interiorly of the frame and bearing upon the combination of the rotary gate and top plate, dispersing a first plurality of said load pads in surrounding relationship to the nozzles in their pour configuration, and, dispersing a second plurality of load pads adjacent the periphery of the rotary gate and top plate, arranging said first and second plurality of load pads to maximize the overlapping of the same to thereby minimize the quantity of load pads needed to cause the rotary gate to deflect into a position conforming to the warpage of the top plate resulting from warpage of the top plate backing, securing the frame and its contained rotary gate and its contained load pads against the top plate by means of opposed pivot toggle and latch toggle mechanisms spaced to provide for removal and replacement of the rotary gate and top plate and rearrangement in toggle actuated compression proportioned to permit the first and second plurality of load pads to accommodate the mutual deflection of the rotary valve and stationary top plate thereby sealing the same against each other in removably secured relationship.

21. A replaceable plate assembly for use in a slidable valve organization having a top plate and a movable gate plate containing refractory surfaces disposed in mutual sliding relation and each having an opening for the pouring of metal when said openings are disposed in registry with one another, said assembly comprising:

(a) a metal housing;

(b) a refractory plate member retained in said housing having an exposed, flat sliding surface, said plate member containing a through-opening penetrating the sliding surface of said member;

(c) a replaceable tubular insert received in said through-opening;

(d) said refractory plate member being assembled from parts separable along a parting line extending through said through-opening; and (e) means for retaining said insert in locked relation in said plate member.

22. A replaceable plate assembly as recited in claim 21, in which said insert-retaining means comprise interlocking grooves integrally formed in the contiguous walls of said through-opening and said insert.

23. A replaceable plate assembly as recited in claim 22, in which said refractory plate member is symmetrical along said parting line.

24. A replaceable plate assembly as recited in claim 23, in which said refractory plate member contains a pair of through-openings longitudinally spaced along said parting line and a replaceable tubular insert received in each of said through-openings.

25. A replaceable plate assembly as recited in claim 24, in which said tubular inserts contain axial openings formed each with different diameters.

26. A replaceable plate assembly as recited in claim 25, in which said parting line is substantially coincident with the longitudinal axis of said plate member.

27. A replaceable plate assembly as recited in claim 25, in which said refractory plate member is divided into a plurality of parts by a plurality of radially spaced parting lines.

28. A replaceable plate assembly as recited in claim 24, in which at least one of said tubular inserts contains an axial opening.

29. A replaceable plate assembly as recited in claim 28, in which one of said tubular inserts is imperforate.

30. A replaceable plate assembly as recited in claim 24, in which:

(a) said tubular inserts extend beyond the surface opposite the sliding surface of said refractory plate member;

(b) said metal housing contains tubular portions enclosing the extended portions of said inserts;

(c) tubular extensions attachable to the extended end of said inserts; and (d) means for detachably securing said extensions to said inserts.

31. A replaceable plate assembly as recited in claim 30, in which said securing means is a bayonet construction.

32. A replaceable plate assembly as recited in claim 31, in which said bayonet connection comprises undercuts on said tubular extensions and mating extensions on the tubular portions of said metal housing.

33. A replaceable plate assembly as recited in claim 21, in which said tubular insert extends axially beyond the surface opposite the sliding surface of said plate member.

34. A slide closure mechanism for controlling the flow of molten metal from a teeming vessel having a wellblock having a tubular working nozzle defining a pour opening therefrom, a casing attached to said vessel, a refractory top plate fixedly received in said casing and containing a nozzle insert defining an orifice aligned with the tubular working nozzle pour opening, a refractory gate plate containing a flow opening and a solid closing portion, said gate plate being movable with respect to said top plate to place said flow opening or said solid portion in registry with said top plate orifice characterized in that, in order to effectively seal the seam between said top plate nozzle insert and said wellblock opening, said nozzle insert extends above the upper surface of said top plate and is sized to extend axially upwardly to abut the lower end of the working nozzle defining a seam therebetween, and a safety collar coaxially containing and surrounding the bottom of the working nozzle and the upper portion of the nozzle insert and the seam defined therebetween.

* * * * *